US006999837B2

(12) United States Patent
Rundberg et al.

(10) Patent No.: US 6,999,837 B2
(45) Date of Patent: Feb. 14, 2006

(54) DEVICE AND METHOD FOR CONTROLLING AND/OR MONITORING A YARN PROCESSING SYSTEM

(75) Inventors: Thomas Rundberg, Vallda (SE); Niklas Wahlgren, Goeteborg (SE); Lars Helge Gottfrid Tholander, Haverdal (SE); Paer Josefsson, Boras (SE)

(73) Assignee: Iropa AG, Baar (CH)

( * ) Notice: Subject to any disclaimer, the term of this patent is extended or adjusted under 35 U.S.C. 154(b) by 26 days.

(21) Appl. No.: 10/501,255

(22) PCT Filed: Jan. 10, 2003

(86) PCT No.: PCT/EP03/00189

§ 371 (c)(1),
(2), (4) Date: Jan. 18, 2005

(87) PCT Pub. No.: WO03/057957

PCT Pub. Date: Jul. 17, 2003

(65) Prior Publication Data

US 2005/0204781 A1 Sep. 22, 2005

(30) Foreign Application Priority Data

Jan. 14, 2002 (SE) ..... 0200096
Jun. 27, 2002 (DE) ..... 102 28 795

(51) Int. Cl.
*G06F 19/00* (2006.01)

(52) U.S. Cl. ..... 700/143; 700/141; 66/232

(58) Field of Classification Search ..... 66/231, 66/232, 237, 238; 139/317–319; 700/130, 700/140, 141, 143

See application file for complete search history.

(56) References Cited

U.S. PATENT DOCUMENTS 4,943,927 A * 7/1990 Yarita et al. ..... 700/140
5,246,039 A 9/1993 Fredriksson
5,323,324 A * 6/1994 Fredriksson ..... 700/130
5,838,570 A * 11/1998 Barea ..... 700/143
6,705,131 B1 * 3/2004 Munoz ..... 66/125 R

FOREIGN PATENT DOCUMENTS

WO WO 90/09474 8/1990

OTHER PUBLICATIONS

International Search Report dated Jun. 17, 2003, in PCT International Application No. PCT/EP03/00189 (4 pages).

* cited by examiner

*Primary Examiner*—Danny Worrell

(74) *Attorney, Agent, or Firm*—Flynn, Thiel, Boutell & Tanis, P.C.

(57) ABSTRACT

A device for controlling and monitoring a yarn processing system, which comprises an electronic main control unit and at least one yarn feeding unit, and inside of which a serial communications field bus system is provided with at least one field bus for carrying out communication. At least one bi-directional event line is provided outside the field bus system in order to transmit a time critical and/or time-specific, digital and anonymous event signal for carrying out and/or confirming events. For at least one communication participant connected to the field bus system, an event specific characteristic feature of respective event signal can be defined by the software side configuration inside the field bus system.

19 Claims, 2 Drawing Sheets

DEVICE AND METHOD FOR CONTROLLING AND/OR MONITORING A YARN PROCESSING SYSTEM

The invention relates to a device and method for controlling and/or monitoring a yarn processing system.

BACKGROUND OF THE INVENTION

When controlling and/or monitoring a yarn processing system a plurality of actively initiated or spontaneous actions or reactions, so-called events, takes place at and/or in different components or functional units which events are triggered and carried out by differing signals and/or which are confirmed by differing signals, respectively. An optimum course of the performance of the yarn processing system only results from a functional co-action between and with a correct timewise sequence of the events.

The main control of the textile machine and at least the control devices of the feeding devices are interconnected by a communication network having the form of a serial communication field bus system comprising one or several field buses for the transmission of signals built into messages. In this case the network can be formed with so-called T-connectors or like a "daisy-chain". Since prioritised events exist, e.g. time critical and/or time specific events, and secondary, less time critical and/or less time specific events, the communication in the field bus system is carried out e.g. by messages which are prioritised by special message types, in order to carry out and/or to confirm the prioritised events without delay. The immense data flood within a complex yarn processing system may lead to the disadvantage that prioritised events cannot be carried out and/or confirmed at the right time with the field bus system.

In earlier known yarn processing systems in which the components or at least a majority of the components were interlinked functionally with each other, a separate signal line was provided for each type of signal. This resulted in complicated cabling and in considerable efforts when processing and/or conditioning the signals.

SUMMARY OF THE INVENTION

It is an object of the present invention to provide a device and a method as mentioned which allow to optimise the definition and the safety for the transmission times of time specific and/or time critical messages or signals in yarn processing systems, and to simplify the synchronisation between the different functional units and the components within the system. In the case of an air jet weaving machine constituting the textile machine of the yarn processing systems such time critical signals would e.g. be the trig signals sent from the weaving machine to the yarn stopping accessory device of each yarn measuring feeding device, or the so-called yarn winding pulses which are to be transmitted to the weaving machine from a winding sensor monitoring the withdrawal of the yarn from the yarn measuring feeding device. In the case of a rapier weaving machine or a projectile weaving machine, respectively, constituting the textile machine, e.g. time critical messages or signals would be the trig signals for controlling the respective controlled yarn tensioning accessory devices provided at the exit sides of the yarn feeding devices.

Summarised, it is an object of the present invention to provide a device and a method as mentioned above allowing to optimally operate even complex yarn processing systems to which a field bus system is associated in view to working speed and to the reliability of the operation with a simple cabling only and so that time critical and/or time specific events are carried out and/or confirmed at the correct time during the operation and for all operation conditions, i.e. also in case of an otherwise extremely large data flood occurring in the communication network.

According to the invention, the event signals are transmitted in real time via the at least one separate event line. The event signals may be simple, fast and short signal pulses. This at least largely excludes the danger of a mutual collision of event signals or the delay of an event signal, respectively. The event line has to transmit only the event signals at the right time and as rapidly as possible from at least one respective sender to at least on respective receiver. The event specific characteristic which belongs to the event signal is transmitted in advance within the field bus system to at least one participant in the communication system in order to define the per se anonymous event signal for the one or several concerned participants in an evaluative fashion. The definition is made by software. Since the event signal and its event specific characteristic are transmitted along separate paths and first are combined at the addressed participants into a meaningful signal, into a command or into a confirmation, the yarn processing system can be controlled and/or monitored optimally. There is sufficient time available for the transmission of the event specific characteristic which is provided in advance within the field bus system in order not to overload the field bus system even in case of a large data flood. The transmission of the event signals along the event lines is not affected in case of a large data flood within the field bus system. The field bus system communicates essentially on a continuous time basis, while events signals are individually transmitted in real time. By means of the different messages communicating within the field bus system, so to speak, the function of the event line is continuously reconfigured or changed during the operation of the textile machine. Although there is essentially only one event line this event line fulfils in this way the task of many signal lines which were needed otherwise for each sort of the events.

This is possible, because there is at least one or there are several specific event lines in addition to the field bus system as the function of a bidirectional digital signal transmission between the textile machine and at least the yarn feeding devices, in which case the transmitted event signals are messages having a time critical or time specific character, so-called event synchronous signals. This may e.g. be trig signals for initiating or carrying out certain and predetermined functions in the yarn feeding devices and the accessory devices of the yarn feeding devices, or in respective accessory devices of the textile machine. These event synchronous signals even may be feedback signals e.g. for confirming initiated and carried out events or indications of the status of specific conditions, functions or components within the yarn processing system, etc.

In a preferred embodiment of the device according to the invention the actual function of the at least one event synchronous line may be defined or configured in relation to time, expediently on a continuous time basis. This is done by means of information of a serial type. This information is sent within the at least one serial field bus which interlinks the textile machine, the yarn feeding devices, and in some case, the accessory devices as provided. The actual function of the event synchronous line is meant to be its intended function at a certain point in time or during a certain time period. This function e.g. may consist of information on the actual type of the next event which is associated to the event signal sent in the at least one event line, and of address information related to the next event signal, i.e. to which or from which node or to which and from which node of the yarn feeding devices/accessory devices the next event signal has to go or has to come.

In other words the field bus system is used to associate a certain function to the at least one event line. The field bus system is apt to continuously vary or subsequently actualise this association of the function in an easily controlled fashion by means of the at least one field bus. The consequence of these capabilities is that the event line continuously is prepared to transmit each occurring time critical and/or time specific event signal precisely and directly at the moment at which it is needed. In this way a completely time-safe control of the yarn processing system can be achieved.

The at least one event line in the yarn processing system is a bidirectional, direct digital line having the purpose of transmitting pulses which indicate events. These pulses indicating an event will be defined in the preferred embodiment by a serial information communication via the field bus system. Bidirectional has the meaning that each node within the system is allowed to use the event line in order to both send or receive event signals (and to read the same).

The function of the event line which, as mentioned, varies in time, is defined or configured by means or via the serial communication field bus system which e.g. has a CAN-bus operating with a CAN-protocol. The field bus of the field bus system contains serial type information related to the type of an upcoming event which will show up in the form of the next event signal on the event line, and also information for which specific node or specific nodes this special event signal is intended, or from which node or nodes it may come. The field bus even may indicate a number of such events such that then this number will be considered by one or by several of the nodes, or the field bus may define a number of events which will happen during a subsequent certain period of time, or until a new definition of the function takes place, which then will erase or substitute the preceding definition of the function.

The structure of the communication system according to the invention allows to configure and vary the function of the event line during the operation of the textile machine. A possible delay time for the consideration of the event signal or for carrying out the event after the transmission of the event signal may even be defined and pre-calculated as soon as the function is defined.

The connecting structure of the at least one event line either is a so-called point-to-point-structure or a multi-drop-structure. In terms of hardware a point-to-point-structure means that e.g. only one event line intended for several events extends to each yarn feeding device. In this single event line an individual event signal driver is provided. Within the multi-drop-structure a single event signal driver is needed only, since there is only one event line to which all yarn feeding devices or other participants are connected.

Within a yarn processing system comprising an air jet weaving machine it will be important time critical events for the weaving machine to start the yarn withdrawal in the respective correct moment, to monitor the number of the yarn windings withdrawn from the respective yarn feeding device, and, finally, to terminate the yarn withdrawal at the respective yarn feeding device. According to the invention this may be realised as follows:

1. At first the weaving machine sends via the field bus, e.g. a CAN-bus, a message which associates the function for a trig signal to the event line. This means that the next following event signal transmitted in the event line has to be a trig signal for a certain event.

2. In the next moment the next following sent CAN-message defines a specific yarn feeding device within the yarn processing system in order to instruct the magnet provided in the yarn stopping accessory device of this yarn feeding device to lift the yarn stopping pin after the expiration of a number of x milliseconds which will be counted upon the transmission of the next following event signal in the event line. This event signal then will be the trig signal according to 1.

3. As soon as the event signal or the trig signal, respectively, is transmitted in the event line the event (the lifting of the yarn stopping pin) will be carried out then when the number x in milliseconds has been counted or when the corresponding period of time has expired.

4. The next following CAN-message gives the same event line the function for the yarn winding pulses of a specific yarn feeding device which yarn winding pulses represent the number of the windings withdrawn. Then the yarn feeding device uses the event line to send these yarn winding pulses which will be monitored and considered by the main control of the weaving machine thanks to the definition given beforehand.

5. After the correct number of the yarn winding off pulses stemming from the selected yarn feeding device has been considered, a further CAN-message again gives the event line the function for a trig signal.

6. The next following CAN-message defines the event which has to be carried out for the related yarn feeding device which is the returning or closing of the yarn stopping pin after the expiration of a number of y milliseconds which will be counted upon occurrence of the next following event signal in the event line (this event signal will be a trig signal according to 5.).

7. In the same moment the feeding device control device of the related yarn feeding device is reading the event signal or trig signal occurring in the event line such that the yarn withdrawal is terminated in accordance with the conditions as defined in 6., i.e., as soon as after the transmission of the event signal the number of y milliseconds has expired. One cycle of a weft yarn insertion (one pick) now has taken place in a correct and time-safe fashion.

The core of the invention is to use for different events only at least one event line in order to transmit the event signals in the simplest form and as rapidly as possible, and to define in advance and by software the event line or the respective event signal, respectively, via the field bus system in order to allow to use it for the respective participant. By a definition in advance of the respective expected event signal which definition in advance varies during the operation of the yarn processing system, the event signals related to differing events can be transmitted on the same event line because they will be specifically identified by the addressed participants in the communication systems due to the definition in advance. The field bus system is well adapted for this identification and has sufficient time for the identification, because it is kept free from the task to transmit the event signals at the correct time or in real time.

Expediently an individual point-to-point-event line for different events is provided between the textile machine and at least each yarn feeding device, preferably with one event signal driver per event line. The event signals will be transmitted along each of these event lines which only then will be associated by the definition via the field bus system to the different events.

Alternatively only a single, common multi-drop-event line is provided between the textile machine and at least the yarn feeding devices, preferably having one common event signal driver.

In the case that at least one accessory device is associated to at least one yarn feeding device, which accessory device can be controlled and/or monitored by the feeding device control, then the accessory device directly may be connected to the event line, or indirectly via the feeding device control. In the case that, to the contrary, at least one accessory device is associated to at least one yarn feeding device, which accessory device has an electronic accessory device control and/or accessory device monitoring, then the accessory device directly may be connected to the event line, or indirectly via the feeding device control. The connection of the accessory device to the field bus system may be made analogously direct or indirect.

In the case that at least one accessory device is associated to the textile machine which accessory device can be controlled or monitored either from the main control or from an individual electronic accessory device control, then the accessory device also may be connected directly to the event line, or indirectly via the main control.

The respective event signal is at least one signal pulse. The events signals for different events may be identical among themselves since they receive their respective meaning first by the definition via the field bus system.

Expediently, the participants of the communication are connected to nodes having addresses. Alternatively, the communication participants may have individual addresses in the field bus system. This simplifies the respective definition in advance of each event signal for the communication participants.

Expediently, the characteristic of the event signal by which the event signal will respectively be defined in advance, may be transmitted for each transmission direction in the event line in each communication direction within the field bus system.

The following characteristics may be defined individually or in combination within the field bus system. Only a selection of different possibilities will be explained:

the type of the event represented by the event signal, the address and/or node address of at least one sender and/or receiver of the event signal among the communication participants, the expected point in time of the event and/or a time window and/or a time period for the event or until the event will happen, the number of events to be expected at one or at several nodes, and a delay time duration which is to be considered respectively between the transmission of the event signal and the initiation and/or confirmation of the event, the consequence of the one or the several event signals which are transmitted at a certain point in time and/or within a determined time window from or to a determined address, and the like.

The signal types which are associated to the event in the yarn processing system (not limiting, only an exemplary listing) may be:

an actuating or de-activating trig signal for a yarn stopping accessory device of a yarn feeding device, a yarn winding count signal of a counting accessory device of a yarn feeding device, a trig signal for actuating or de-activating a yarn stretching accessory device of a yarn feeding device located at an exit of the yarn feeding device, a trig signal for activating, de-activating or adjusting a controlled yarn braking accessory device within the yarn path, a signal of a weft yarn detector accessory device or a yarn breakage detector accessory device along the yarn path which is to be expected at a predefined point in time or within a predefined time window, an event confirmation signal, an event inhibition signal, a status signal of at least one communication participant which is to be expected or which is to be asked for at a predetermined point in time or within a predetermined time window, etc.

According to the method the respective event signal may be defined such that it can be used from at least one addressed communication participant, even if the event signal is transmitted on the event line to several participants. When defining the event signal the addressed communication participant is informed which event is meant by the next following event signal. Alternatively, the communication participant is informed about an expectation point in time or a time period or a time window, and, in some cases, about at least one sender address belonging to the event signals.

BRIEF DESCRIPTION OF THE DRAWINGS

Embodiments of the invention will be described with the help of the drawings, in which.

DETAILED DESCRIPTION

In the following yarn processing systems will be described having a respective weaving machine as a textile machine and also having weft yarn feeding devices as feeding devices. However, the invention also can be employed for other yarn processing systems such as e.g. a knitting machine and knitting yarn feeding devices.

Figure 1:
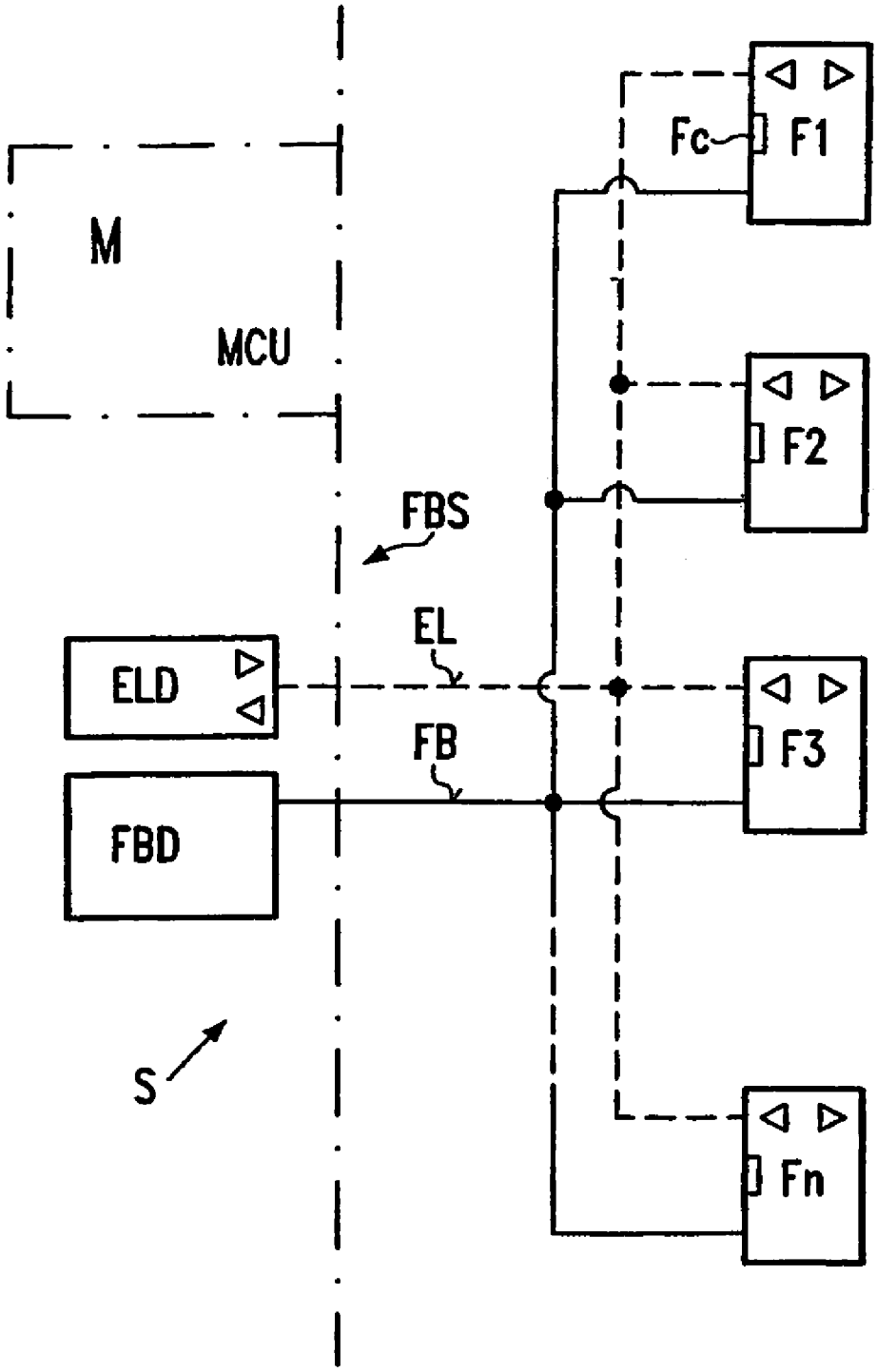
FIG. 1 is a schematic illustration of a yarn processing system.

A yarn processing system S in FIG. 1 includes a textile machine M having an electronic main control MCU and several yarn feeding devices F1, F2, F3 to Fn. Furthermore, a field bus system FBS is provided including at least one field bus FB which interconnects the main control MCU and the yarn feeding devices F1 to Fn, the latter expediently via yarn feeding device controls FC. At least one field bus driver FBD for a bidirectional serial data transmission is provided within the field bus system FBS. Separate from the field bus system FBS an event line EL is provided to which all yarn feeding devices F1 to Fn and the main control MCU are connected either directly or via the field bus FB. An event signal driver ELD is provided for the event line EL. As indicated by arrows in the respective blocks the event line EL serves for signal transmissions in each transmission direction.

The method for controlling and/or monitoring the yarn processing system S in FIG. 1 is explained with the assumption that the textile machine M is an air jet weaving machine and that the associated yarn feeding devices F1 to Fn are so-called weft yarn measuring feeding devices, each having a yarn stopping accessory device. Furthermore, a further accessory device in the form of a so-called winding count sensor (not shown) is arranged at each yarn feeding device which sensor counts during each insertion a withdrawn yarn winding and generates at least one signal then. A magnet is arranged within the yarn stopping accessory device for lifting a not shown yarn stopping pin out of the yarn path. The stopping pin can be returned from the lifted position again into the lowered position by spring load or by the magnet, respectively. In the lowered position of the yarn stopping pin the yarn withdrawal is interrupted. In the lifted position of the yarn stopping pin the yarn windings are withdrawn one by one by the air jet weaving machine.

An insertion in the yarn channel occupied by the yarn feeding device F3 is controlled and monitored as follows:

1. The air jet weaving machine sends a message via the field bus FB (e.g. a CAN-bus) which associates the function for a trig signal to the event line EL. This means that the subsequent event signal will be a trig signal for a certain event, namely for lifting the yarn stopping pin in the yarn feeding device F3.

2. In the next moment the next sent e.g. CAN-message defines the yarn feeding device F3 in the yarn processing system. The message gives the order that the magnet has to lift the yarn stopping pin x milliseconds after the occurrence of the subsequent event signal in the event line. Consequently, this event signal will be the trig signal according to 1.

3. As soon as the event signal is transmitted via the event line EL, the event or the function according to 2, will be carried out, as soon as x milliseconds have expired.

4. The next e.g. CAN-message associates winding counting pulses from the yarn feeding device F3 to the event line EL. During withdrawal of the yarn the winding count accessory device generates yarn minding pulses which are sent by the yarn feeding device F3 into the event line EL. These yarn winding pulses are monitored and registered by the main control MCU of the air jet weaving machine.

5. After a predetermined, correct number of yarn winding off pulses originating from the yarn feeding device F3 have been monitored and counted, a new sent e.g. CAN-message will associate the event line EL again to a trig signal.

6. The next following e.g. CAN-message defines for the yarn feeding device F3 that the accessory device of the yarn feeding device F3 has to lower or close of the yarn stopping pin y milliseconds after the occurrence of the next following event signal in the event line as the event. This event then will be the trig signal according to 5.

7. Immediately after this point in time the yarn feeding control FC in the yarn feeding device F3 reads the incoming event signal in the event line EL as a trig signal. The yarn withdrawal is terminated in accordance with the condition defined in 6, i.e., as soon as y milliseconds have expired upon occurrence of the event signal. One cycle of the weft yarn insertion (one pick) then has taken place in the correct fashion and with a proper timing.

Figure 2:
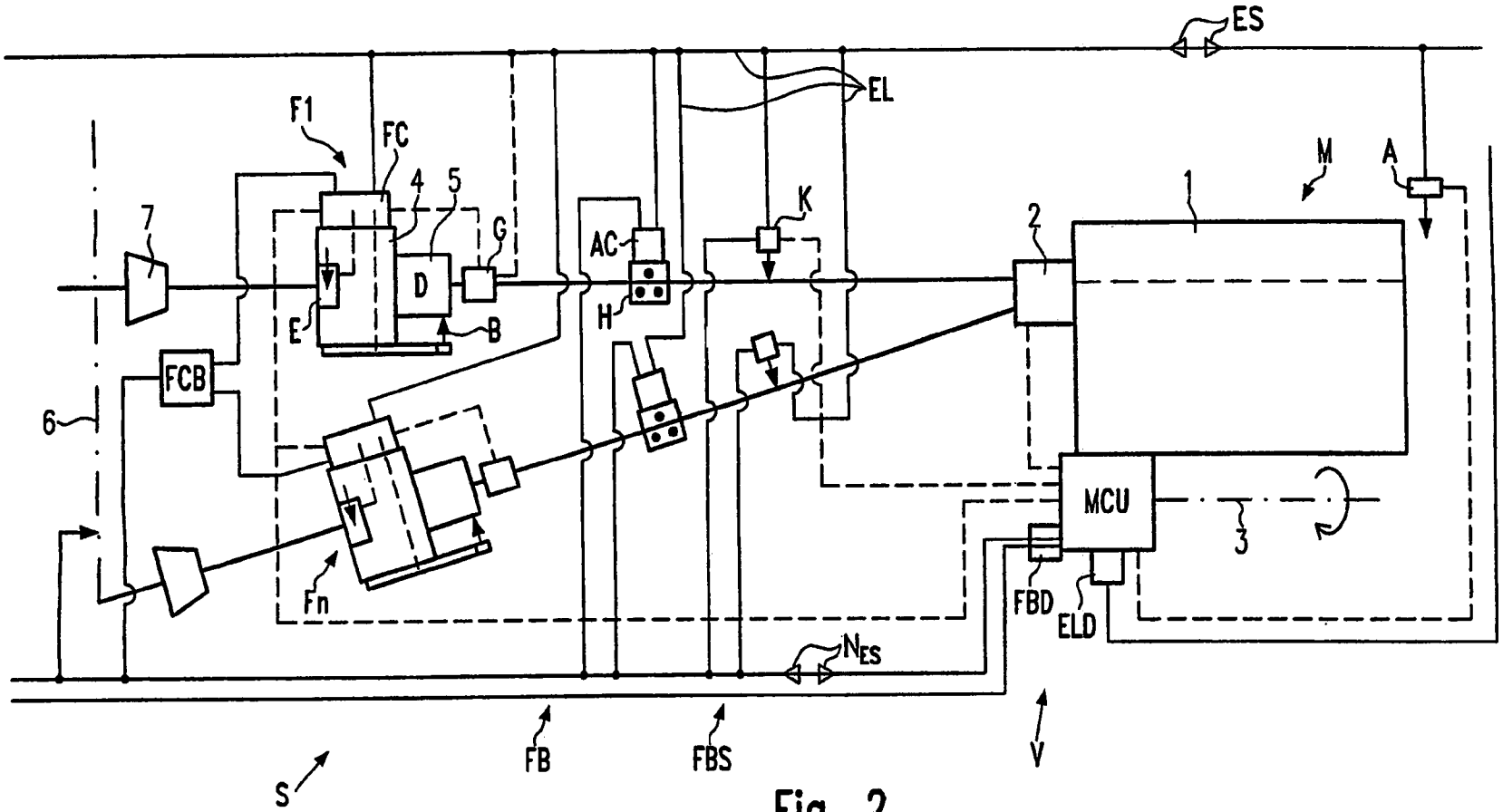
FIG. 2 is a detailed schematic illustration of a yarn processing system.

In the yarn processing system in FIG. 2 an air jet weaving machine is indicated as the textile machine M to which at least two yarn feeding devices F1, Fn are associated in separated yarn channels. The air jet weaving machine has a weaving shed 1, an insertion and yarn selecting assembly 2, and a main shaft 3, of which the rotational angle ranges or rotational angles are monitored in coded fashion by the main control MCU. Furthermore, e.g. at the side of the weaving shed remote from the yarn feeding devices an accessory device A in the form of an arrival sensor is provided which confirms the arrival of the free weft yarn tip e.g. by an okay signal and/or which generates a fault signal in case that the free tip of the weft yarn has not arrived at a predetermined point in time or within a predetermined time window, respectively.

Each yarn feeding device F1, Fn is a so-called weft yarn measuring feeding device which measures the weft yarn length for each insertion. A housing 4 supports a storage drum 5. Furthermore, at the inlet side an accessory device E in the form of a yarn breakage detector or yarn run detector is provided and connected to the yarn feeding device control FC. Furthermore, a yarn stopping accessory device D is provided and connected to the yarn feeding device control FC. Finally, even an accessory device B in the form of a yarn winding count sensor may be oriented the storage drum 5 which sensor generates at least one count signal for each withdrawn winding and transmits the count signals to the yarn feeding device control FC. The accessory device D has at least one magnet by which a yarn stopping pin can be lifted from a lowered stopping position (stopping the yarn against withdrawal) into a release position (releasing the yarn for withdrawal), and which then can be returned.

At the withdrawal side of the yarn feeding device an accessory device G in the form of a yarn stretcher may be provided which, in some cases, may be connected to the yarn feeding device control FC. In the further course of the yarn path an accessory device H in the form of a controlled yarn brake having an individual accessory device control AC may be provided. Furthermore, a weft yarn monitor may be arranged as an accessory device K within the yarn path.

Each yarn feeding device F1 to Fn pulls off yarn from a storage bobbin 7 provided in a storage bobbin stand 6. At the stand, as well, accessory devices (not shown) may be provided for monitoring and/or controlling certain functions.

A serial communication system in the form of a field bus system FBS interconnects the main control MCU and the yarn feeding devices F1, Fn by means of at least one field bus FB. The yarn feeding device controls FC either are connected directly to the field bus FB (not shown), or, as shown, via a so-called yarn feeding device control box FCB. Even the stand 6, the accessory devices H, K and in some cases the accessory device A may be connected to the field bus FB. For such purposes nodes are provided which have predefined addresses.

Accessory devices associated to at least one respective yarn feeding device may be connected to the respective yarn feeding device control FC. Accessory devices associated to the textile machine, to the contrary, may be connected to the main control MCU. The field bus system FBS contains at least one common field bus driver FBD by which the transmission of messages NES is carried out in both transmission directions within the field bus system FBS.

Separate from the field bus system FBS one event line EL is arranged in a multi-drop structure, to which different communication participants of the field bus system FBS are connected. The event line EL serves for the transmission of event signals ES at the correct time or in real time, respectively, and selectively in each transmission direction. In this case the event signals ES may be relatively simple signal pulses. The feeding device controls FC are directly connected to the event line EL, while the accessory devices E, D, B, G are connected to the event line EL via the feeding device controls FC. Differently, the accessory devices H, K, A and also the main control MCU, are directly connected to the event line EL. Even not shown accessory devices at the stand 6 may be connected to the event line EL.

In a not shown alternative individual point-to-point-event lines may be provided to the respective communication participants in the field bus system FBS. Then each event line is equipped with an individual event signal driver ELD.

An insertion cycle for one weft yarn of the yarn feeding device F1 is controlled and monitored in the fashion as explained with the help of FIG. 1. The further accessory devices are controlled and/or monitored in analogous fashion.

The indirect definition of an event signal which will be generated in the form of a fault signal from the accessory device A (arrival sensor) in case of a not arriving weft yarn is carried out e.g. in the following way:

The main control MCU is informed by the yarn winding count pulses about the movement of the weft yarn through the weaving shed. The point in time of or a time window for the arrival of the free weft yarn tip at the accessory device A is known. By a corresponding message NES in the field bus system FBS e.g. after receipt of the first yarn winding count pulse it is defined that an event signal transmitted at the predefined point in time or within the predefined time window will be a fault signal from the accessory device A and will have the consequence that the weaving machine has to be switched off. In case that the event signal is transmitted at the predefined point in time or within the predefined time window, the main control MCU will switch off the weaving machine.

In a similar way an event signal transmitted during an insertion cycle from a weft yarn monitor (accessory device K) will be recognised as representing the event of a yarn breakage or a yarn stop caused by a fault and will be registered such that at least the weaving machine will be switched off.

In this case e.g. the signal of the weft yarn monitor upon start of the yarn within a time window will be defined via the field bus system as an expected event signal from the node addressed to the main control MCU. Furthermore, the consequence of the receipt of this event signal will defined. In case that the event signal will be received as an okay signal, nothing will be done. In case that the event signal does not arrive, a determination is made that a yarn breakage has occurred, and the machine will be switched off. As a definition also an inquiry for at least one event signal may be carried out at the predetermined point in time or within a time window, respectively.

The activation or deactivation or adjustment of the accessory device H e.g. is made by communicating the message via the field bus system FBS that the next following event signal is intended for the node address of the accessory device H only and has to be ignored by all other communication participants.

In a very complex system a point-to-point-structure of several event lines may be more expedient in order to allow to handle as many as possible event signals at the appropriate time.

In the case of a rapier weaving machine as the textile machine of the yarn processing system, e.g. the controlled yarn brake is actuated as the accessory device by defining by the node address of the yarn feeding device control of the operating yarn channel or by the node address of the controlled yarn brake in the field bus system at which point in time the respective event signal for the activation will arrive and at which point in time the event signal for the deactivation of the controlled yarn brake will arrive. In this case the points in time or the time windows e.g. are associated to the rotational angle of the main shaft of the weaving machine by calculations or the like and also the event signals will be transmitted depending therefrom. In this way it is assured that the yarn tension will be increased accordingly when the bringer gripper grips the yarn, so that then the yarn tension will be decreased, so that the yarn tension again will be increased, as soon as the bringer gripper transfers the yarn to the taker gripper, and so that the yarn tension again will be decreased after the transfer.

In case of a projectile weaving machine the controlled yarn brake similarly will be activated and deactivated by using respective event signals. In this case the purpose and the point in time or the time window of the event signals are transmitted in advance to the respective correct addresses by messages within the field bus system.

In a similar way also in other yarn processing systems which e.g. include a knitting machine and knitting yarn feeding devices associated to the knitting machine and, in some cases, accessory devices, may be controlled and/or monitored with event signals the meaning of which will be respectively defined via the field bus system.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A device for controlling or monitoring a yarn processing system, comprising:

a textile machine having an electronic main control, at least one yarn feeding device having an electronic feeding device control and being associated with the textile machine, and a serial communication field bus system within which as communication participants at least the feeding device control and the main control communicate via at least one field bus, wherein at least one event line which is separated from the field bus system is provided between the textile machine and the at least one yarn feeding device for a real time transmission of time critical or time specific digital and anonymous event signals for executing or confirming different time critical or time specific events in the yarn processing system, and that the respective event signal is defined prior to the transmission for at least one communication participant via the field bus system by at least one event specific characteristic.

2. The device as in claim 1, wherein the at least one event line comprises an individual point-to-point-event line provided between the textile machine and the at least one yarn feeding device, said individual point-to-point-event line containing an event signal driver.

3. The device as in claim 1, wherein the at least one event line comprises a single and common multi-drop event line provided between the textile machine and the at least one yarn feeding device, said multi-drop event line containing at least one common event signal driver.

4. The device as in claim 1, wherein at least one accessory device is associated to the at least one yarn feeding device which accessory device is controlled or monitored by the feeding device control, and wherein the accessory device is connected to the event line directly or via the feeding device control.

5. The device as in claim 1, wherein at least one accessory device is associated to the at least one yarn feeding device which accessory device has an electronic accessory device monitor, and wherein the accessory device is connected to the event line, either directly or via the feeding device control.

6. The device as in claim 1, wherein at least one accessory device is associated with the textile machine and the accessory device is controlled or monitored by the main control or by an individual electronic accessory device control, and wherein the accessory device is directly connected to the event line.

7. The device as in claim 1, wherein the event signal comprises at least one signal pulse.

8. The device as in claim 1, wherein the communication participants are connected to addressed nodes of the field bus system, or are provided with respective addresses within the field bus system.

9. The device as in claim 1, wherein the event specific characteristic of the event signal is defined in each communication direction in the field bus system for each transmission direction in the event line.

10. The device as in claim 1, wherein the event specific characteristic comprises one of:

the type of the event represented by the respective event signal, the address of a sender of the respective event signal, the node address of a sender of the respective event signal, the address of at least one receiver of the respective event signal, the node address of at least one receiver of the respective event signal, the expected point in time of an event, a time window for the an event, the number of expected events at one or more nodes, a delay time duration which has to be considered between the transmission of the respective event signal and the execution and/or confirmation of the event, a delay time duration which has to be considered between transmission of the respective event signal and confirmation of the event, the consequence of the event respective signal which is transmitted from or to a predefined address, the consequence of the event respective signal which is transmitted at a predefined point time, and the consequence of the event respective signal which is transmitted within a predefined time window.

11. Device as in claim 1, wherein the respective event signal is representing a signal type comprising one of:

an activating trig signal for a yarn feeding device stopping accessory device, an deactivating trig signal for a yarn feeding device stopping accessory device, a yarn winding count signal of a yarn feeding device count accessory device, a trig signal for activating a yarn stretching accessory device arranged at an exit side of the at least one yarn feeding device, a trig signal for deactivating a yarn stretching accessory device arranged at an exit side of the at least one yarn feeding device, a trig signal for activating a controllable yarn braking accessory device arranged within a yarn path, a trig signal for deactivating a controllable yarn braking accessory device arranged within a yarn path, a trig signal for adjusting a controllable yarn braking accessory device arranged within a yarn path, an okay signal of a weft yarn monitoring or yarn breakage detector accessory device arranged within a yarn path, a fault signal of a weft yarn monitoring or yarn breakage detector accessory device arranged within a yarn path, an event confirmation signal, an event inhibition signal, an okay status signal of at least one communication participant, and a fault status signal of at least one communication participant.

12. A method for controlling or monitoring a yarn processing system comprising:

a textile machine having an electronic main control, at least one yarn feeding device having an electronic feeding device control and being associated with the textile machine, and a serial communication field bus system including at least one field bus in which field bus system at least the feeding device control and the main control communicate as participants, the method comprising:

connected communication participants communicating within the field bus system by messages such that time critical or time specific, prioritised events are executed or confirmed as functions of the yarn processing by at least one selected communication participant, executing or confirming execution of the respective event e by at least one anonymous real time event signal transmitted via at least one event line which is separated from the field bus system, and defining by software at least one event specific characteristic which informs at least one communication participant about the meaning of the expected event signal for the at least one selected communication participant in advance of the transmission of the event signal in the event line via the field bus system by at least one message representing the characteristic.

13. The method as in claim 12, wherein at least one event specific characteristic is defined by an aspect comprising one of: an expected point in time, a time window, a time duration, and a sender address.

14. A device for communicating in and for controlling a yarn processing system including:

a textile machine, one or more yarn feeding devices associated with the textile machine, and at least one accessory assembly associated with the textile machine or the one or more yarn feeding devices, the accessory assembly comprising one of: control for uncontrolled yarn stretchers, brakes, and yarn sensors, wherein the textile machine comprises a main control, wherein each of the one or more yarn feeding devices comprises an individual feeding device control, wherein the device comprises a serial communication field bus system which is provided with one or more parallel bus lines, via which field bus system at least the respective feeding device controls of the yarn feeding devices are connected to the main control of the textile machine, wherein one or more specific event synchronous lines are provided, separate from the field bus system, as functions for bidirectional digital signal transmissions between the textile machine and the yarn feeding devices, and wherein the yarn processing system contains event synchronous signals and predefined feedback pulses for confirming the initiated or executed functions, or for indicating events.

15. The device as in claim 14, wherein the function of the one or more event specific synchronous lines in relation to intended function at a predefined point in time, or within a predefined time period, is defined on a continuous time basis, based upon information which is sent within the field bus system interconnecting the textile machine, the one or more yarn feeding devices, and the at least one accessory assembly, wherein the intended function of the one or more event specific synchronous lines comprises one of: information about the type of the next following event signal which will be sent in the one or more specific event lines, information about the type of the event signal which occurs within the event line, address information representing from which node or nodes of the one or more yarn feeding devices the next following event is to be expected, and address information representing from which node or nodes of the at least one accessory assembly the next following event is to be expected.

16. The device as in claim 14, wherein an individual feeding device control is further provided for the accessory assemblies of the feeding device.

17. The device as in claim 5, wherein the accessory device is further connected to the field bus system, either directly or via the feeding device control.

18. The device as in claim 1, wherein at least one accessory device is associated with the at least one yarn feeding device which accessory device has an electronic accessory device control, and wherein the accessory device is connected to the event line.

19. The device as in claim 18, wherein the accessory device is further connected to the field bus system, either directly or via the feeding device control.

* * * * *